US005668360A

United States Patent [19]

Perret et al.

[11] Patent Number: 5,668,360

[45] Date of Patent: Sep. 16, 1997

[54] CIRCUIT-BREAKER HAVING TWO INTERRUPTING CHAMBERS PER POLE WITH DRIVE MECHANISM AND DRIVE RODS ISOLATING INSERT CAPACITORS

[75] Inventors: Michel Perret, Bourgoin-Jallieu; Denis Dufournet, Bron; Joseph Martin, Meyzieu, all of France

[73] Assignee: GEC Alsthom T & D SA, Paris, France

[21] Appl. No.: 583,804

[22] Filed: Jan. 5, 1996

[30] Foreign Application Priority Data

Jan. 6, 1995 [FR] France ..... 95 00114
May 17, 1995 [FR] France ..... 95 05852

[51] Int. Cl.[6] ..... H01H 33/12; H01H 33/16

[52] U.S. Cl. ..... 218/5; 218/7; 218/84; 218/143; 218/144; 218/154

[58] Field of Search ..... 218/2–8, 43, 57–67, 218/84, 143, 144, 154

[56] References Cited

U.S. PATENT DOCUMENTS 3,676,621 7/1972 Pflanz ..... 218/143 X
3,896,282 7/1975 Chabala ..... 218/62
4,365,126 12/1982 Oshima et al. ..... 218/143
4,486,633 12/1984 Calvino ..... 218/84 X
5,510,591 4/1996 Tramblay et al. ..... 218/43

FOREIGN PATENT DOCUMENTS 25 38 130 A1 3/1977 Germany ..... H01H 33/14
1590833 6/1981 United Kingdom ..... H01H 33/42

OTHER PUBLICATIONS

*Patent Abstracts of Japan*, vol. 14, No. 344 (E–0955), 25 Jul. 1990 corresponding to JP–A–02 117043 (Toshiba Corp) dated 1 May 1990.

*Primary Examiner*—J. R. Scott
*Attorney, Agent, or Firm*—Sughrue, Mion, Zinn, Macpeak and Seas

[57] ABSTRACT

A circuit-breaker having two interrupting chambers per pole, the chambers being disposed in a T or V configuration at the end of a column provided at its base with a control system for operating a drive rod, each chamber containing a moving assembly connected via a linkage to the drive rod, and main contacts and arcing contacts, wherein each chamber contains a semi-moving assembly including main contacts and arcing contacts co-operating respectively with the main contacts and the arcing contacts of the moving assembly, the semi-moving assembly in each of the chambers including a mechanism for moving it at a velocity of equal magnitude and of opposite direction to the velocity of the moving assembly with which it co-operates.

2 Claims, 6 Drawing Sheets

CIRCUIT-BREAKER HAVING TWO INTERRUPTING CHAMBERS PER POLE WITH DRIVE MECHANISM AND DRIVE RODS ISOLATING INSERT CAPACITORS

The present invention relates to a circuit-breaker having two interrupting chambers per pole, the chambers being disposed in a T or V configuration.

An object of the present invention is to provide such a circuit-breaker which requires low drive energy so that the cost of the equipment with its control system is also low.

BACKGROUND OF THE INVENTION

Circuit-breakers having two interrupting chambers per pole commonly contain both a fixed portion comprising main contacts, arcing contacts, and a blast piston, and also a moving portion comprising main contacts and arcing contacts, and a blast cylinder. In a variant, the piston is placed on the moving portion, the cylinder then being fixed. The moving portion is moved on circuit-breaker disengagement or engagement by means of rods connected via a linkage to a drive rod moved by a control system placed at the bottom of the column supporting the two interrupting chambers.

The drive energy required for disengagement is proportional to the mass of the moving parts and to the square of the relative speed of separation of the contacts. The relative speed of contact separation is imposed mainly by the characteristics of the current to be interrupted, and by the pressure of the insulation gas. The control energy may be reduced by reducing the mass of the moving parts, but such reductions are unavoidably limited by the need to provide equipment that is robust and reliable.

The idea underlying the present invention is that the energy can be reduced if the disengagement speed is halved, with this being done by imparting the same speed simultaneously both to the moving assembly and to the "fixed" assembly, which same speed is equal to half of the above-mentioned relative speed of contact separation. It can then be understood that the assembly that is usually fixed in each of the interrupting chambers must be made "semi-moving", and both the moving assembly and the semi-moving assembly must be provided with means for being driven in opposite directions and with opposite velocities on disengagement.

It is known that the voltage across the terminals of each of the chambers of the pole is generally not equal to half of the total voltage of the line. Usually, the voltage of the line is distributed in proportions in the vicinity of 70% and 30%. In order to avoid over-dimensioning the chambers so as to make it possible to interrupt voltages greater than half the line voltage, it is well known to dispose voltage-distributing capacitors referred to as "balancing" capacitors in parallel with each interrupting chamber. Such capacitors are generally placed in ceramic columns disposed above the interrupting chambers. Such columns are costly.

OBJECTS AND SUMMARY OF THE INVENTION

Another object of the invention is to house the balancing capacitors cheaply by omitting conventional insulating columns. The idea underlying the solution to this problem is to make the rods connecting the semi-moving assembly of one chamber to the moving element of the other chamber in the form of tubes containing capacitor elements.

To these ends, the invention provides a circuit-breaker having two interrupting chambers per pole, the two chambers being disposed in a T or V configuration at the end of a column provided at its base with a control system for operating a drive rod, each chamber containing a moving assembly connected via a linkage to the drive rod, and main contacts and arcing contacts, wherein each chamber contains a semi-moving assembly including main contacts and arcing contacts co-operating respectively with the main contacts and the arcing contacts of the moving assembly, the semi-moving assembly in each of the chambers includes a mechanism for moving it at a velocity of equal magnitude and of opposite direction to the velocity of the moving assembly with which it co-operates.

In a particular embodiment of the invention, the semi-moving assembly of each of the chambers is connected via a respective rod to the moving assembly of the other chamber.

Advantageously, the rod comprises a tube enclosing capacitor elements disposed in series and constituting a capacitor whose ends are electrically connected respectively to the semi-moving element of one chamber and to the moving element of the other chamber.

BRIEF DESCRIPTION OF THE DRAWINGS

The invention will be well understood on reading the following description of an embodiment of the invention given with reference to the accompanying drawings, in which.

MORE DETAILED DESCRIPTION

Figure 1:
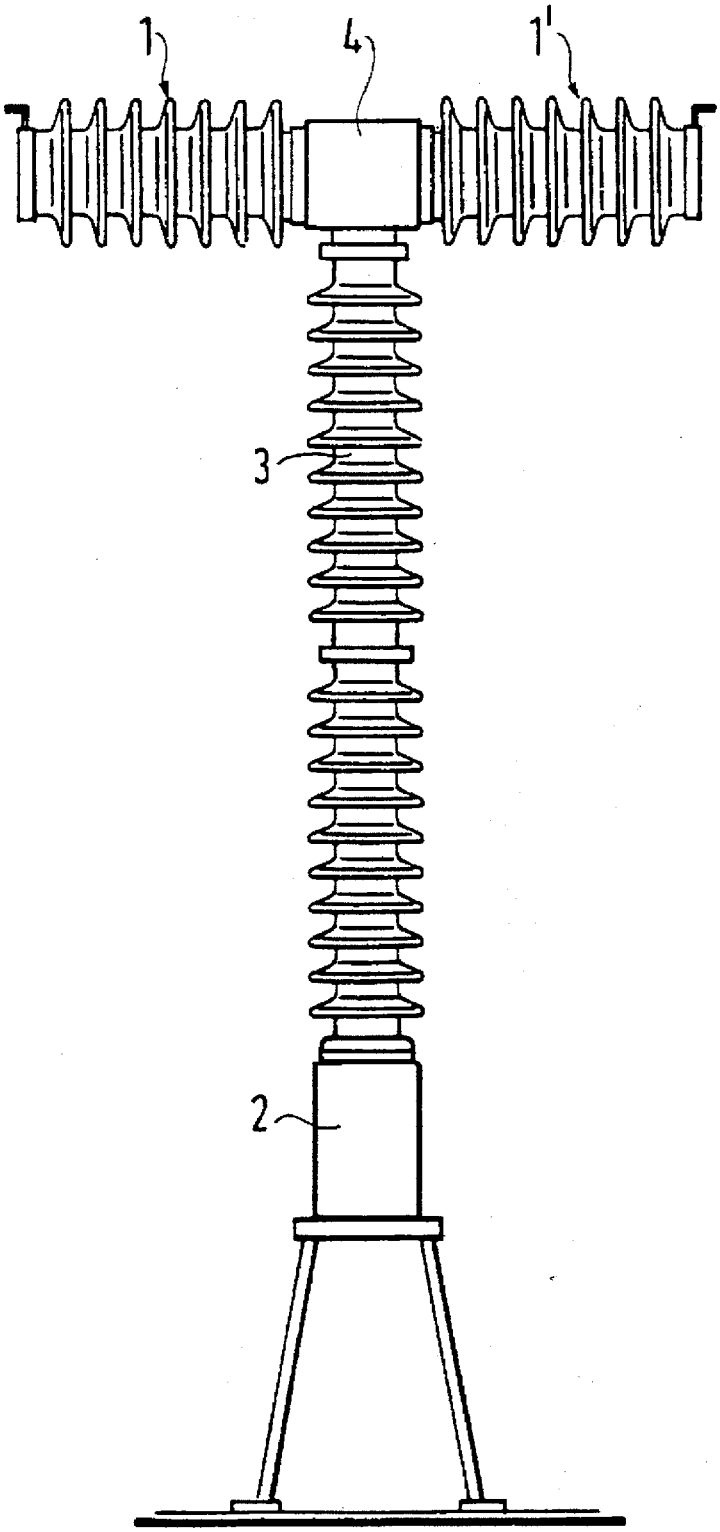
FIG. 1 is an elevation view of a circuit-breaker pole having two interrupting chambers disposed in a T configuration.

FIG. 1 shows a circuit-breaker pole having two interrupting chambers disposed in a T configuration. A three-phase circuit-breaker comprises three identical poles.

FIG. 1 shows two interrupting chambers 1 and 1' disposed at the top of an insulating column 3. The chambers are connected to the column via a metal casing 4. At the base of the column, a control system 2 is disposed for operating the pole.

Figure 2:
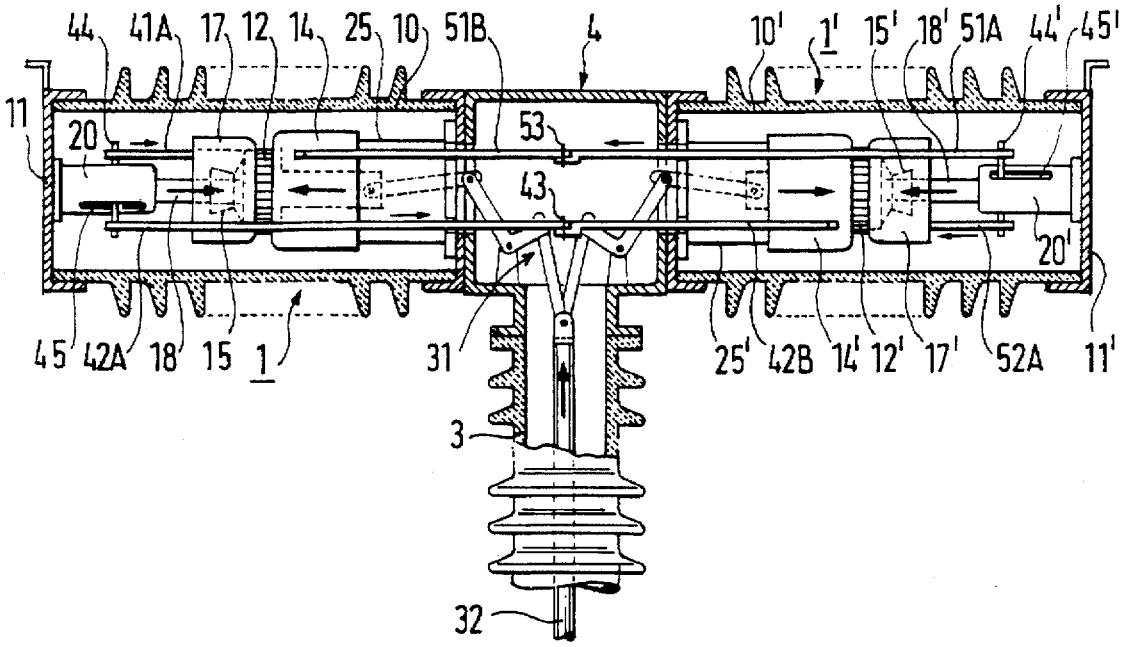
FIG. 2 is a fragmentary view in partial axial section of the interrupting chambers of the pole, the circuit-breaker being in the engaged position.
Figure 3:
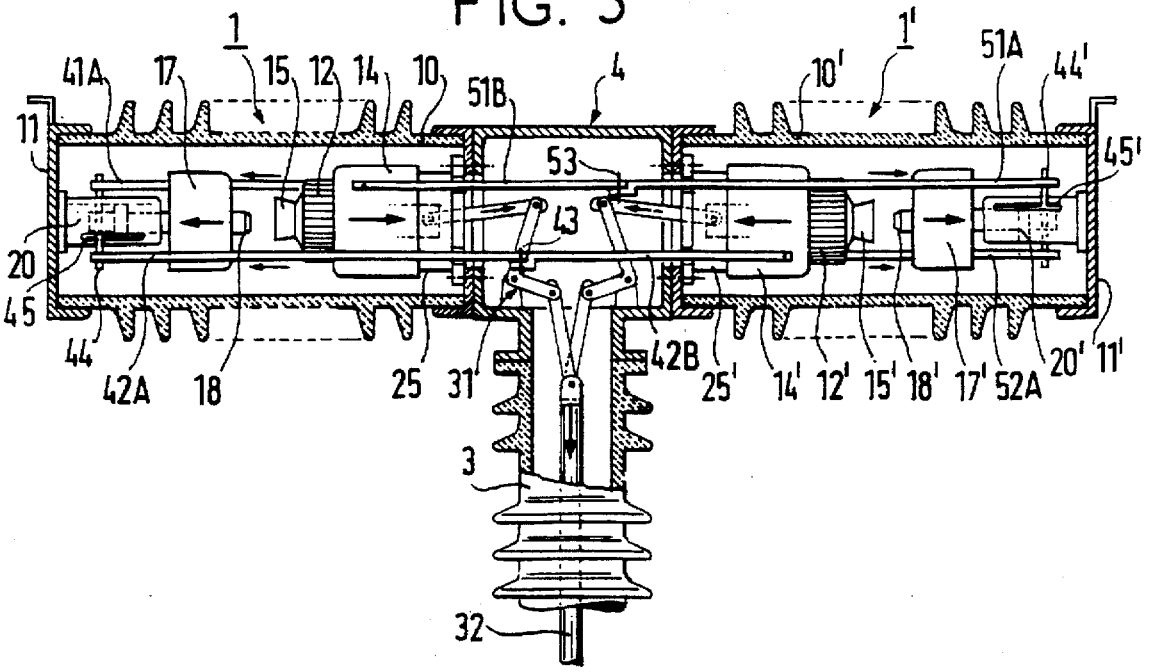
FIG. 3 is a fragmentary view in partial axial section of the interrupting chambers of the pole, the circuit-breaker being in the disengaged position.
Figure 4:
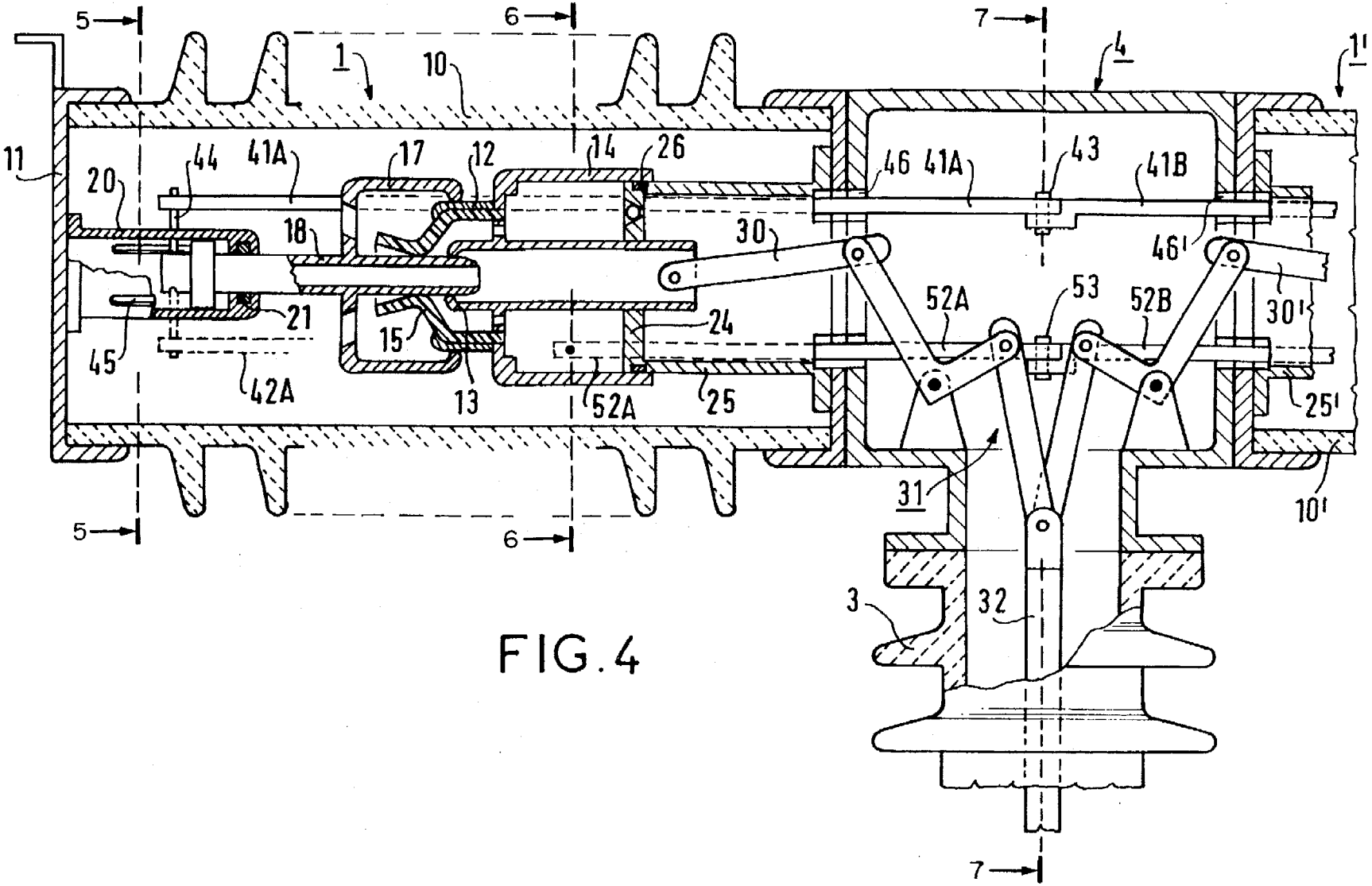
FIG. 4 is a view in axial section on an enlarged scale of an interrupting chamber of a circuit-breaker configuration.
Figure 5:
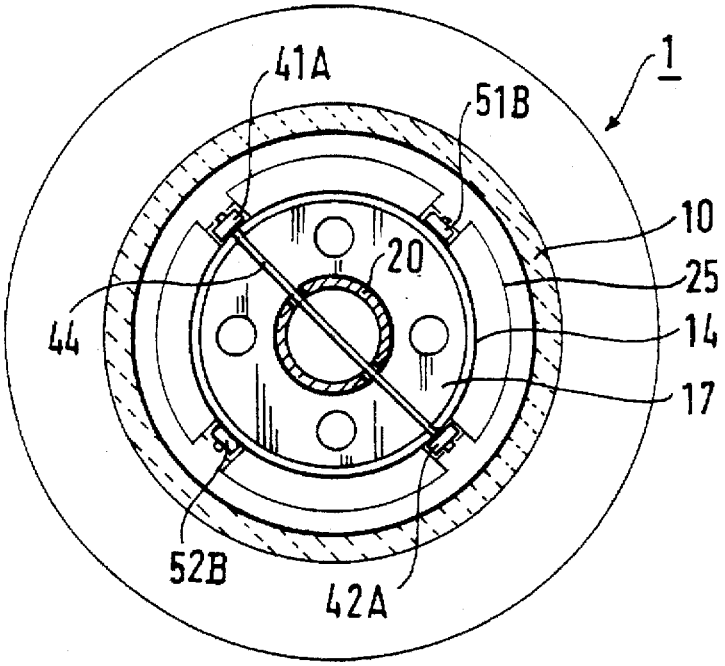
FIGS. 5, 6, and 7 are section views respectively on lines 5—5, 6—6 and 7—7 shown in FIG. 4.
Figure 6:
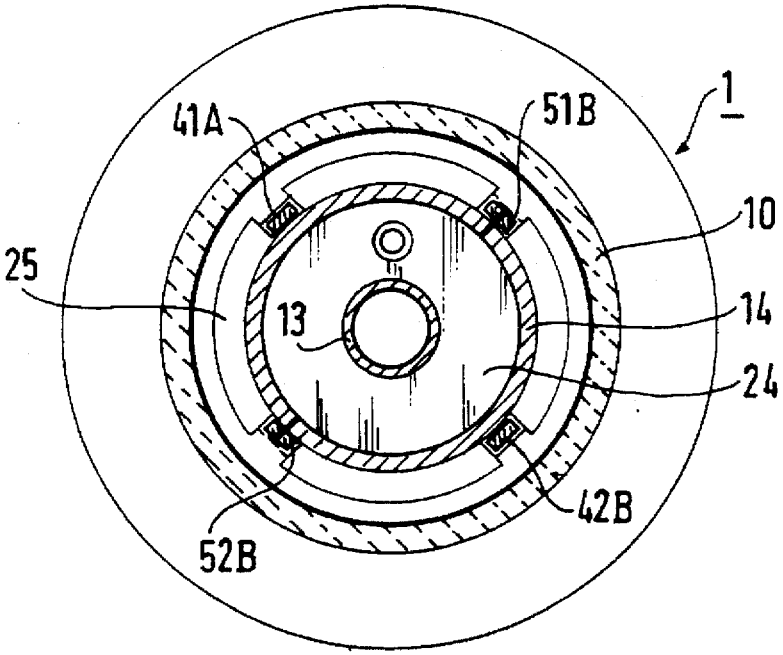
Figure 7:
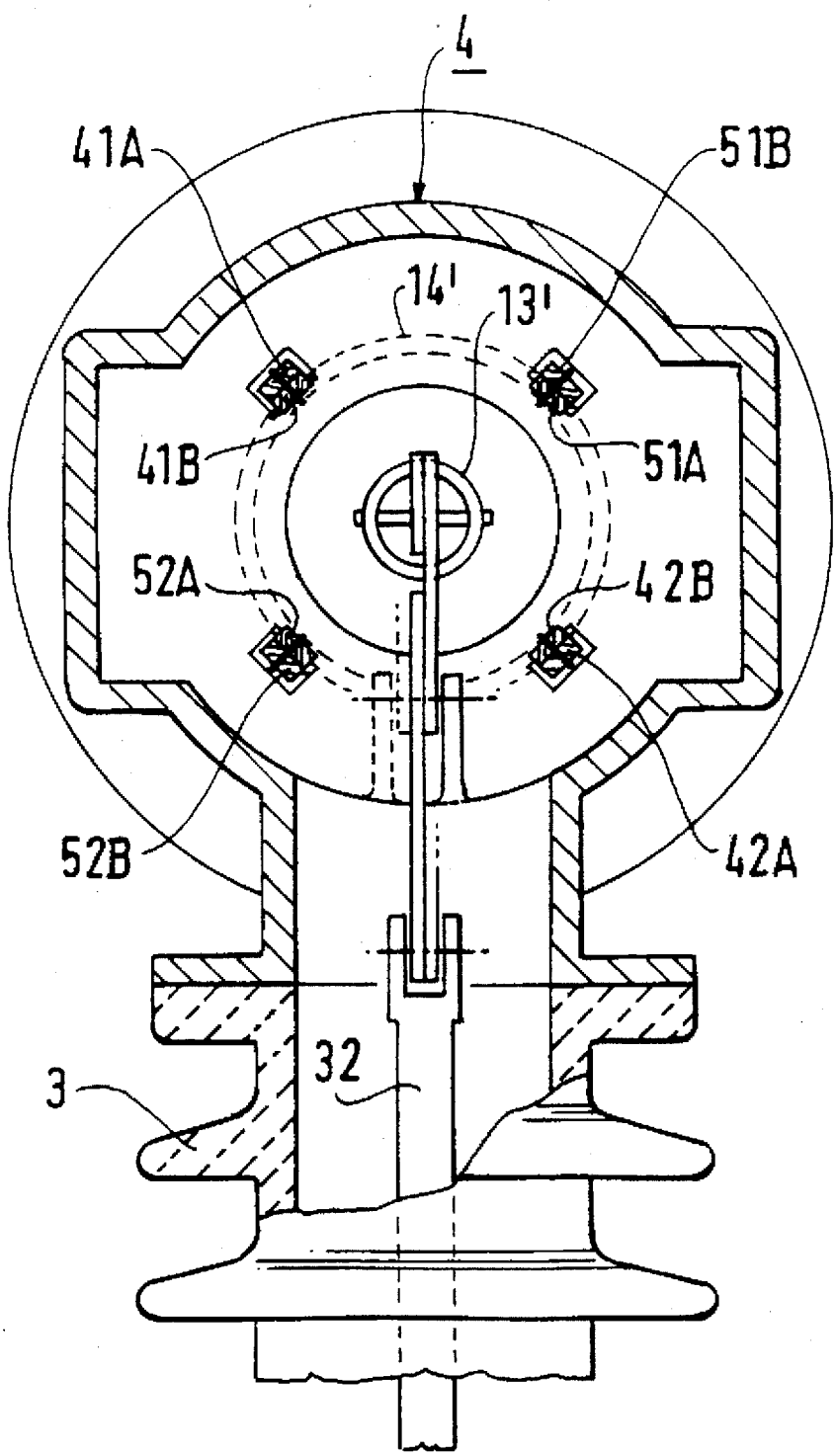

Reference is made below to FIGS. 2 to 4.

Since the two chambers of the pole are identical, only chamber 1 is described in detail, the corresponding elements in chamber 1' receiving the same references followed by the prime symbol (').

The chamber 1 is provided with an insulating jacket 10, e.g. made of ceramic, fixed via one end to the casing 4, and closed at the other end by means of an end plate 11 constituting a terminal.

The chamber contains a moving main contact 12 secured to a moving arcing contact 13, to a blast cylinder 14, and to a blast nozzle 15; and a semi-moving or follower main contact 17 secured to a semi-moving arcing contact. The semi-moving or follower arcing contact 18 is guided inside a metal cylinder 20 secured to the end plate 11. Electrical contacts 21 enable current to pass between the semi-moving contacts and the terminal 11.

The cylinder 14 co-operates with a metal piston 24 disposed at the end of a cylindrical part 25 fixed to the metal casing 4. Electrical contacts 26 enable current to pass between the cylinder 14 and the cylinder 25.

The moving assembly is driven by a connection rod 30 connected via a linkage 31 to a drive rod 32 actuated by the control system placed at the base of the column 3.

When the circuit-breaker is closed, current flows between the end plate 11, the cylinder 20, the contacts 21, the semi-moving contact 17, the moving contact 12, the cylinder 14, the contacts 26, the cylinder 25, the casing 4, the cylinder 25', the contacts 26', the cylinder 14', the moving contact 12', the semi-moving contact 17', the contacts 21', the cylinder 20', and the end plate 11'.

The circuit-breaker is opened (disengaged) by the drive rod 32 being displaced downwards under the action of the control system of the circuit-breaker. The moving assemblies 12-13-14 and 12'-13'-14' are displaced simultaneously towards each other.

The principle of the invention is that each semi-moving or follower assembly is constrained to effect a simultaneous movement at a velocity of equal magnitude and of opposite direction to the velocity of the corresponding moving assembly. In the embodiment described and shown, this is obtained by securing the moving assembly 12-13-14 of chamber 1 to the semi-moving assembly 17'–18' of chamber 1', and by securing the semi-moving assembly 17–18 of chamber 1 to the moving assembly 12'-13'-14' of chamber 1' by means of insulating rods.

The semi-moving assembly 17–18 is connected to the moving assembly 12'-13'-14' by insulating rods 41A–41B and 42A–42B. In order to facilitate assembly, the insulating rods are made in two portions that are assembled together inside the casing by a coupling such as 43. Rods 41A and 42A are interconnected via a transverse pin 44 passing through a slot 45 in the cylinder 20. These rods pass through the wall of the casing via openings 46 and 46' therein. Rods 41B and 42B pass through the casing and are fixed at two diametrically opposite points on cylinder 14'.

The moving assembly 12-13-14 of chamber 1 is secured to the semi-moving assembly 17'–18' of chamber 1' in analogous manner by means of rods 51A–51B, 52A–52B angularly disposed at 90° from rods 41A–41B, 42A–42B.

As shown in FIG. 3, on circuit-breaker opening, the moving and semi-moving assemblies move with velocities of equal magnitude and of opposite direction. By this disposition, the drive energy can be reduced significantly.

By this invention, while retaining the same relative speed of contact-separation, the kinetic energy to be used on disengagement is divided by four, if the moving masses remain unchanged.

According to a second characteristic of the invention, the link rods are used to house the capacitors.

Figure 8:
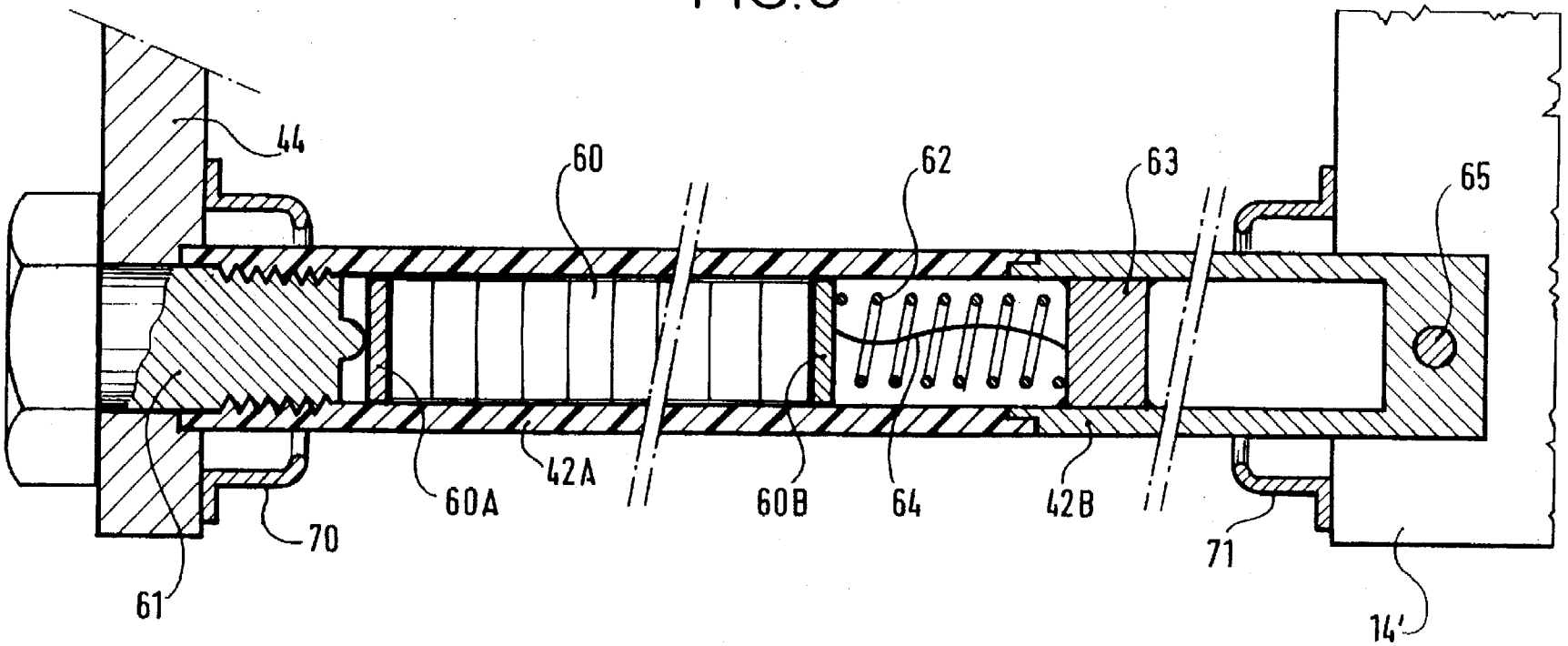
FIG. 8 a section view of a rod enclosing capacitor elements.

By way of example, consideration is given below to the rod 42A–42B connecting the semi-moving assembly 20 of the left chamber to the moving assembly 14' of the right chamber (as shown in FIG. 8).

The tube 42A is made of an insulating material, and it contains a plurality of pellets 60 forming the same number of capacitor elements in series. The tube 42B is made of metal.

The set of capacitor elements is clamped between two metal end plates 60A and 60B.

Clamping is effected by a metal screw 61 passing through the transverse pin 44 and by a spring 62 bearing against a metal block 63 bonded to the inside of the tube 42B.

The electrical contact between the end 60B of the stack and the block 63 may be improved by means of a metal braid 64. The tube 42B is electrically and mechanically connected to the moving assembly 14' by means of a pin 65.

The end 60A of the stack is electrically connected to the semi-moving assembly 17 by a transverse pin 44.

By way of example, for a 500 kV circuit-breaker having two interrupting chambers, the voltage distribution is about 70%–30% in the absence of balancing capacitors.

With a capacitor having capacitance of about 120 pF in parallel with each chamber, the distribution is 55% –45%.

This improvement makes it possible to avoid over-dimensioning the chambers.

It is possible to obtain the value of 120 pF by providing each of the four rods with 16 capacitor elements having the following characteristics:

diameter: 26 millimeters (mm);

thickness: 9 millimeters;

capacitance: 1,000 pF; and voltage rating: 15 kV.

By equipping a tubular rod with 16 capacitor elements of the above-mentioned type, the following are obtained:

a stack length equal to: 16×9 mm=144 millimeters;

a maximum voltage rating equal to 16×15 kV=240 kV; and capacitance equal to: 1,000 pF/16=62.5 pF.

Since the four rods are mounted in parallel in pairs, each pair of rods has a capacitance equal to:

$$62.5\text{pF}\times 2=125\text{ pF}.$$

Thus, the problem of installing capacitors of suitable capacitance in parallel with the chamber walls is solved reliably, simply, and cheaply.

Anti-corona caps such as caps 70 and 71 may be provided so as to smooth the potential curves in the vicinity of the joins between the rods and the semi-moving elements and between the rods and the moving elements.

The invention is not limited to the embodiment described and shown, and it is applicable, for example, to circuit-breakers having two chambers disposed in a V configuration for each pole.

We claim:

1. A circuit-breaker having first and second interrupting chambers per pole, said first and second chambers being disposed in a T configuration at the end of a column provided at its base with a control system for operating a drive rod, each of said first and second chambers containing a moving assembly with main and arcing contacts connected via a linkage to said drive rod, and each of said first and second chambers further containing a follower assembly with main and arcing contacts, said main contacts and said arcing contacts of said follower assembly in said first chamber operative to cooperate respectively with said main contacts and said arcing contacts of a corresponding said moving assembly in said first chamber, and said main contacts and said arcing contacts of said follower assembly in said second chamber operative to cooperate respectively with said main contacts and said arcing contacts of a corresponding said moving assembly in said second chamber, wherein said follower assembly in said first chamber is connected to said moving assembly in said second chamber by insulating rods, and said follower assembly in said second chamber is connected to said moving assembly in said first chamber by further insulating rods, such that each follower assembly is constrained to move simultaneously at a velocity of equal magnitude and of opposite direction to the velocity of the corresponding said moving assembly located within the same chamber therewith.

2. The circuit-breaker according to claim 1, wherein each of said insulating rods comprises a tube enclosing capacitor elements disposed in series and constituting a capacitor whose ends are electrically connected to the follower assembly of said first chamber and to the moving assembly of said second chamber.

* * * * *